US007303301B2

(12) United States Patent
Koren et al.

(10) Patent No.: US 7,303,301 B2
(45) Date of Patent: Dec. 4, 2007

(54) SUBMERSIBLE LED LIGHT FIXTURE

(75) Inventors: Paul Koren, Altamonte Springs, FL (US); Roy Archer, Orlando, FL (US); Stephen Faber, Orlando, FL (US); Michael Bauer, Orlando, FL (US)

(73) Assignee: Nexxus Lighting, Inc., Orlando, FL (US)

( * ) Notice: Subject to any disclaimer, the term of this patent is extended or adjusted under 35 U.S.C. 154(b) by 19 days.

(21) Appl. No.: 11/265,691

(22) Filed: Nov. 1, 2005

(65) Prior Publication Data

US 2007/0097675 A1 May 3, 2007

(51) Int. Cl.
*F21V 33/00* (2006.01)

(52) U.S. Cl. ..... 362/101; 362/96; 362/267; 362/294; 362/373

(58) Field of Classification Search ..... 362/96, 362/101, 362, 294, 373, 267
See application file for complete search history.

(56) References Cited

U.S. PATENT DOCUMENTS

| | | | | |
|---|---|---|---|---|
| 5,266,742 | A * | 11/1993 | Heier et al. | 174/93 |
| 6,616,291 | B1 * | 9/2003 | Love | 362/101 |
| 7,125,146 | B2 * | 10/2006 | Willis et al. | 362/267 |
| 2003/0048632 | A1 * | 3/2003 | Archer | 362/101 |

* cited by examiner

*Primary Examiner*—Sandra O'Shea
*Assistant Examiner*—James W Cranson, Jr.
(74) *Attorney, Agent, or Firm*—Akerman Senterfitt

(57) ABSTRACT

A submersible light fixture which includes a housing, and an LED light engine mounted to a heat-conducting plate, with the heat conducting plate being supported by the housing. The housing defines an opening adjacent to the heat-conducting plate, and the opening is designed to be in fluid communication with a body of water when the light fixture is submerged such that the water acts as a heat sink to the LED light engine. In one arrangement, the opening is a gap between the heat-conducting plate and a watertight container containing a control module for the LED light engine.

20 Claims, 7 Drawing Sheets

SUBMERSIBLE LED LIGHT FIXTURE

CROSS-REFERENCE TO RELATED APPLICATIONS

Not Applicable.

FIELD OF THE INVENTION

This invention is directed generally to light emitting diode (LED) fixtures, and more particularly, to submersible LED light fixtures for use underwater in swimming pools, spas and the like.

BACKGROUND OF THE INVENTION

Generating visible light with traditional light sources, such as incandescent or fluorescent light sources, is inefficient because thermal energy is also produced as by-product of the process. The wasted thermal energy is generally directed away from the light source in the direction of the radiant beam of light. Fixtures such as light shades or reflectors, or even the target illuminated by the light source, receive the wasted thermal energy, and consequently, rise in temperature. In some instances, the rise in temperature can reduce the useful life of a product. Further, the arrangement of traditional light sources are limited to designs that can withstand the wasted thermal energy. In underwater applications, wasted thermal energy is typically dissipated into the water, however, this does not prevent the light fixtures from having a relatively short life due to this excess heat.

It is also known to use fiber-optic cables for underwater lighting, but fiber-optic lighting is expensive and difficult to install, and is not suitable for the retro-fitting of existing pools. Additionally, the fiber-optic light fixtures are not as bright as traditional incandescent light fixtures, and are therefore not well used in pool and other underwater lighting applications.

In contrast to traditional light sources, solid state lighting, such as light emitting diode ("LED") fixtures, are more efficient at generating visible light than many traditional light sources. However, single LED lights are typically not bright enough for illuminating objects or for use in pool and other underwater lighting. In order to use LEDs for illumination, a cluster of LED fixtures must be provided. Although LEDs do not generally radiate heat in the direction of the beam of light produced, implementation of LEDs for many traditional light source applications has been hindered by the amount of heat build-up within the electronic circuits of the LEDs. This heat build-up is particularly problematic as more LEDs are added to a cluster. Heat build-up reduces LED light output, shortens lifespan and can eventually cause the LEDs to fail.

Accordingly, heat sinks have been used to dissipate heat away from LEDs; however, in the past, LEDs have been thermally coupled to heat sinks with adhesive tapes. The use of adhesive tape introduces several problems, such as the labor and time intensive process of providing tape for each individual LED. Further, adhesive tapes are susceptible to being displaced during the assembly process, resulting in less than optimal heat dissipation. Particular problems arise when the light fixture is intended for use underwater in a swimming pool, spa, fountain, sink or other water feature. Not only must a heat sink be provided, it must be able to withstand being submerged. For example, it is not possible to use adhesive tape to connect an LED to a heat sink in a fixture designed to be submerged, because the adhesive can dissolve in water, causing the connection to the heat sink to be broken.

LED light engines have recently become available, which supply multiple LED lights in an array. The light engines make it possible to provide a high lumen light using LEDs, and it is desirable to use such light engines in swimming pool, spa and other underwater lighting. However, the management of heat generated by the light engines is critical to maintaining the performance of the LED array, and it is therefore desirable to be able to package an LED light engine in such a way that it can be used in underwater applications.

SUMMARY OF THE INVENTION

The present invention provides a submersible light fixture which includes a housing, and an LED light engine abutting a heat conducting plate, with the heat conducting plate being supported by the housing. The housing defines an opening substantially adjacent to the heat-conducting plate, and the opening is designed to be in fluid communication with a body of water when the light fixture is submerged such that the water acts as a heat sink to the LED light engine.

Preferably, the LED light engine is mounted to the heat conducting plate. In one arrangement, the opening can be a gap between the heat conducting plate and a watertight container containing a control module for the LED light engine. Preferably, at least a portion of the watertight container located adjacent to the gap is formed of a non-electrically conducting material.

The opening is preferably additionally in fluid communication with a watertight container containing a control module for the LED light engine. The light fixture watertight container for the control module can include a heat conducting base plate that acts to dissipate heat from the control module to the water. A wall of the watertight container for the control module may be ribbed to allow water to flow along the sides of the container.

The light control module and the LED light engine can be electrically connected through a watertight sleeve extending across the gap. In a preferred arrangement, the sleeve can be positioned off-center to the center of the LED light engine, allowing the center of the LED light engine, which generates the highest temperatures, to be directly thermally connected by the water, through the heat conducting plate. The sleeve is preferably formed of a non-electrically conducting material.

The LED light engine can include a plurality of LEDs which produce red, green and blue light. The LED light engine can be protected from contact with water by the heat conducting plate, and by at least one lens positioned over the LED light engine. In one arrangement, the heat conducting plate can be formed of a metallic material.

These and other arrangements and advantages are described in relation to the accompanying drawings.

BRIEF DESCRIPTION OF THE DRAWINGS

There are shown in the drawings embodiments which are presently preferred, it being understood, however, that the invention is not limited to the precise arrangements and instrumentalities shown.

DETAILED DESCRIPTION OF THE PREFERRED EMBODIMENTS

Figure 1:
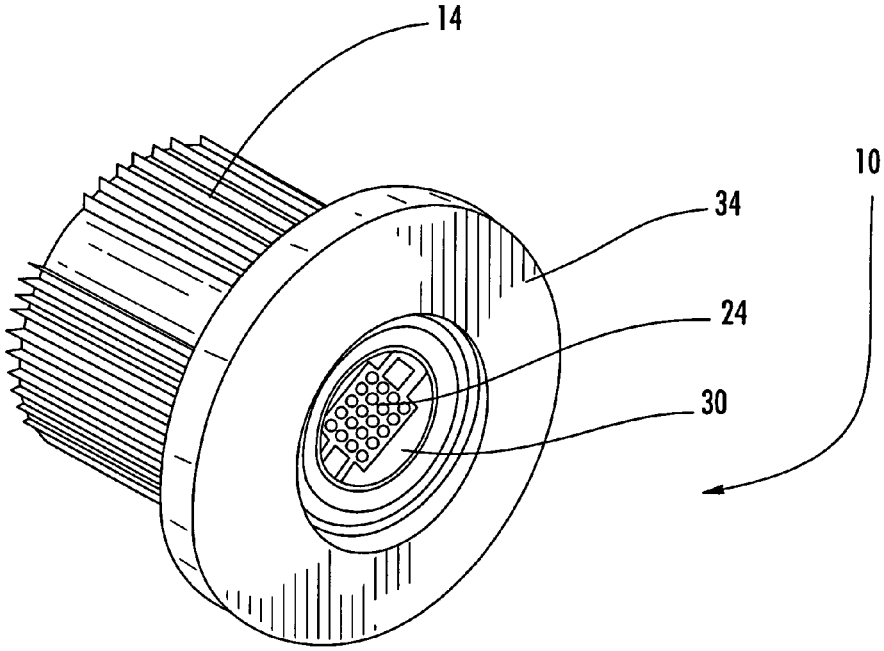
FIG. 1 is a perspective view of a submersible light fixture according to the inventive arrangements.
Figure 2:
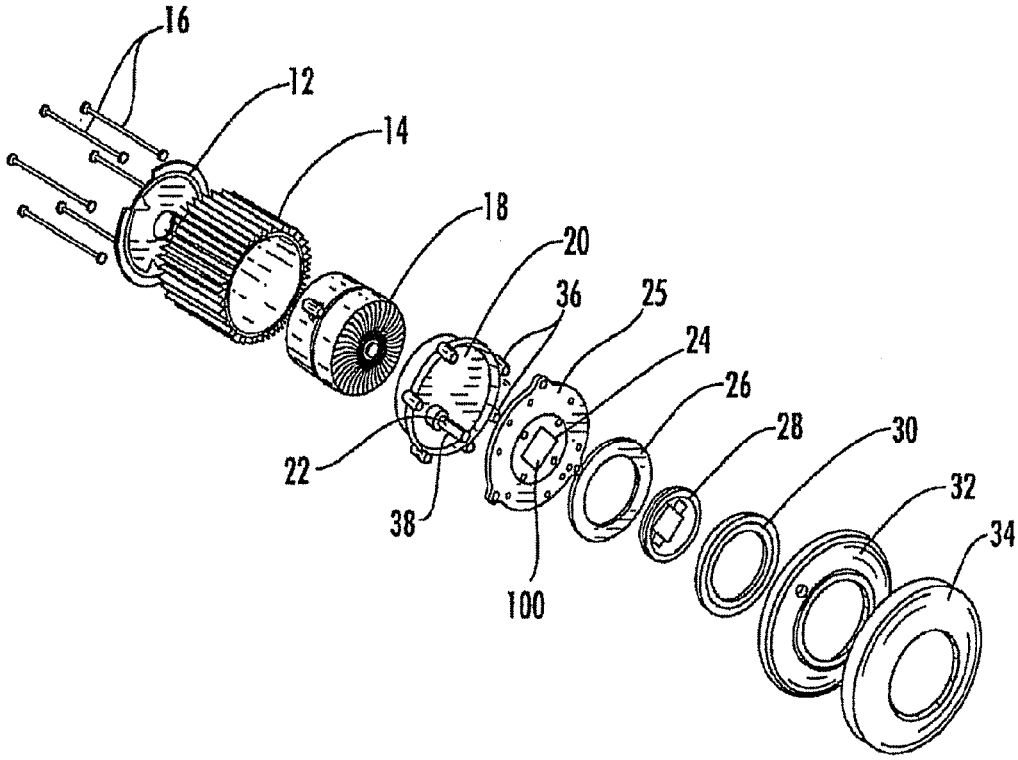
FIG. 2 is an expanded perspective view of the submersible light fixture of FIG. 1.
Figure 3:
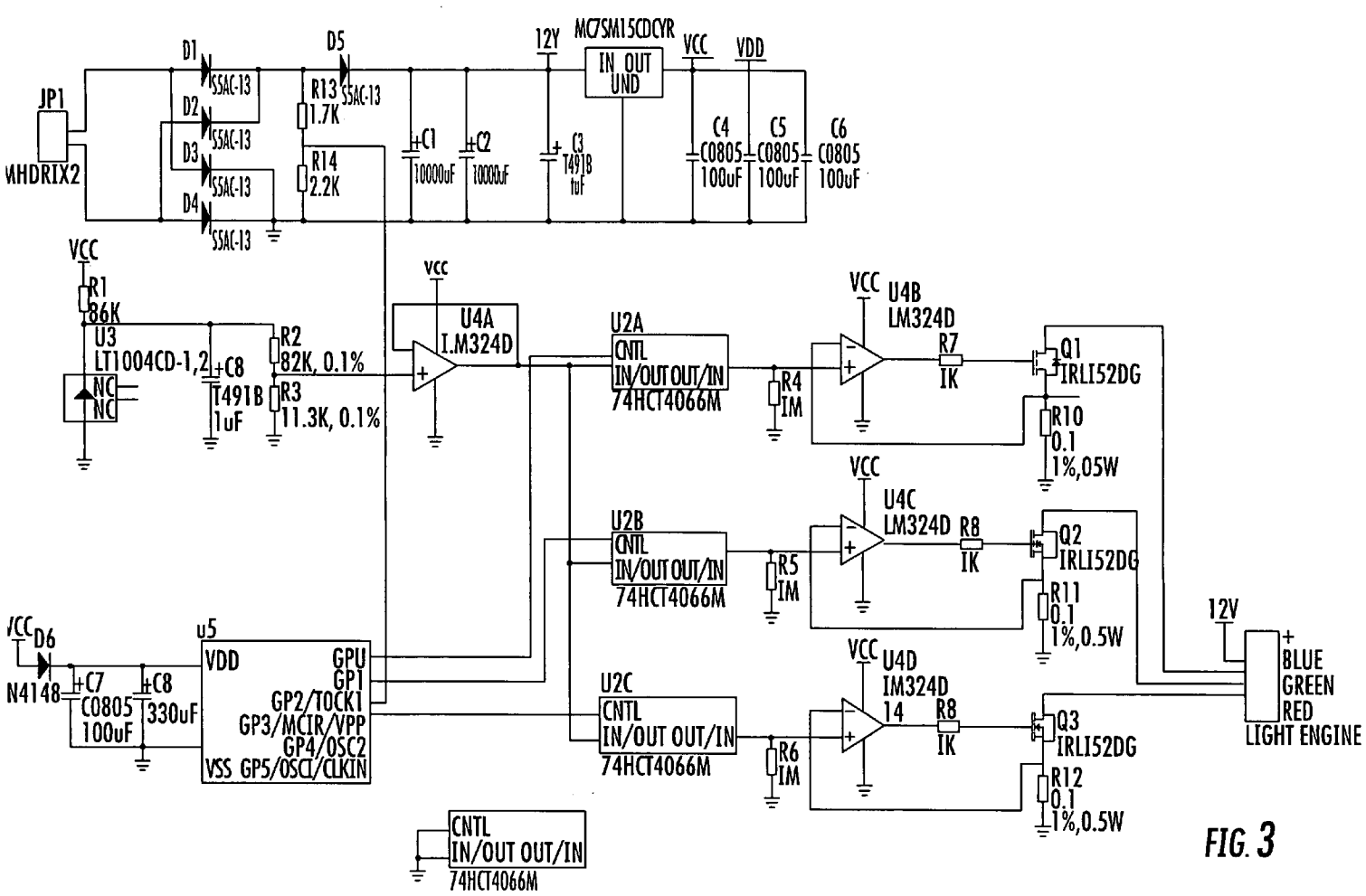
FIG. 3 is a circuit diagram for the submersible light fixture of FIG. 1.
Figure 4:
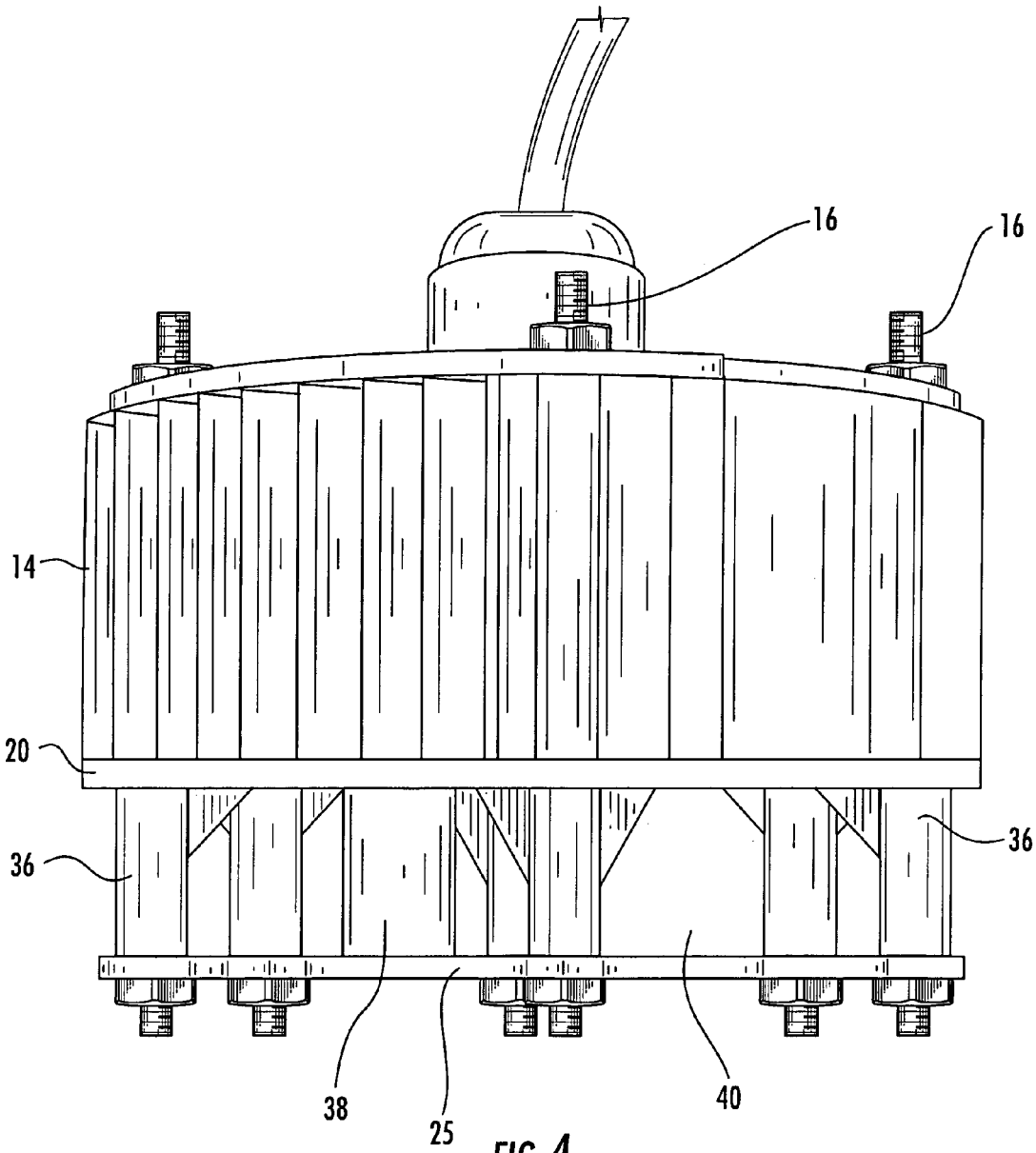
FIG. 4 is a side view of the sleeve and LED light engine used in the submersible light fixture of FIG. 1
Figure 5:
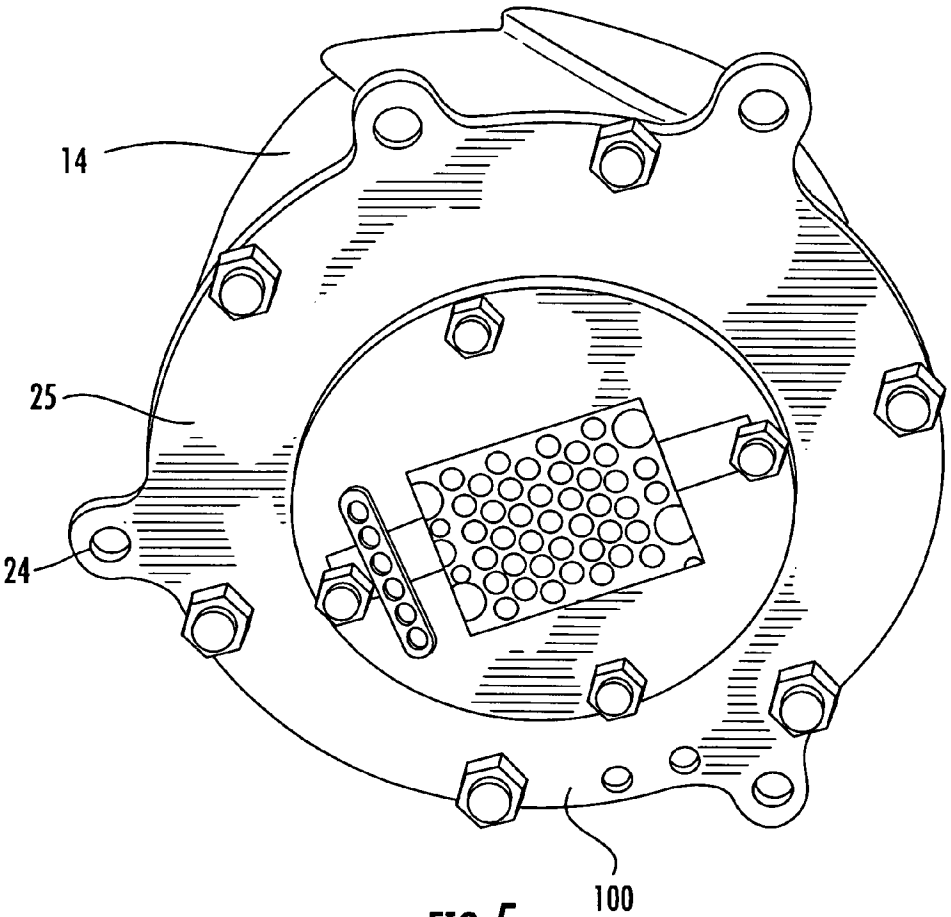
FIG. 5 is an end view of the sleeve and LED light engine of FIG. 4

The present invention provides light emitting diode (LED) fixtures, and more particularly, submersible LED light fixtures for use in swimming pools, spas and the like. It will be appreciated that the LED fixtures are intended for use in any suitable underwater application such as swimming pools, spas, fountains, sinks, waterfalls or any other water feature, and is not limited in this regard.

An arrangement of the present invention is illustrated in the accompanying drawings. These figures show a submersible LED light fixture according to the present invention. The light fixture 10 can include a base plate 12, which may be mounted to a ribbed outer sleeve 14 by screws 16. A control module 18 is located within the sleeve 14, and the sleeve is capped by a cap 20. The cap 20 includes an aperture for an electrical connection 22 to an LED light engine 24 that is mounted on a metallic plate 25. The LED light engine 24 is protected from water by a lens arrangement including an annular washer 26, a spacer 28, a lens 30, a lens collar 32, and an outer collar 34.

The base plate 12 is preferably formed of a heat conducting material, such as a metallic material. The sleeve 14 and the cap 20 are formed of any suitable material, and are preferably formed of a plastic or nylon material to provide a watertight, non-electrically conducting housing for the control module 18.

The cap 20 is configured to have several protrusions 36 extending therefrom, which form sleeves for the screws 16. The screws 16 extend through the cap 20, and secure the metallic plate 25 to the base plate 12 and ribbed outer sleeve 14. In the illustrated embodiment, there are six protrusions 36 because there are six screws 16, but any number of screws may be used. The electrical connection 22 is also surrounded by a sleeve 38. The sleeves 36, 38 enable the metallic plate 25 to be positioned away from the cap 20, creating a gap 40 between the cap 20 and the plate 25.

The light fixture 10 is mounted in a wall of a swimming pool, spa or other water feature such that the gap 40 is open to and in fluid communication with the water. The water can enter into the gap, and directly contact the plate 25 to form a heat sink that is used to cool the LED light engine 24 because the LED light engine should be operated at or below 125° C. for optimal performance. This is because LEDs are sensitive to heat and must be kept below this temperature to avoid severe degradation and catastrophic failure of the LED. In addition, lifetime and light output decreases with increasing temperature, even if the LED is kept below 125° C. A heat sink must therefore be attached to the array with sufficient cooling capacity to keep the die junction below 125° C. In a preferred arrangement, the electrical connection 22, and sleeve 38 are positioned off-center from the center of the LED light engine 24 so that the center of the LED light engine 24, which typically has the highest temperatures, is in direct thermal communication with the water in the gap 40 through the plate 25. Additionally, the water can travel down the sides of the ribbed sleeve 14 and can then contact the base plate 12. The base plate 12, which in a preferred arrangement is metallic, can dissipate heat from the control module 18 into the body of water.

Figure 6:
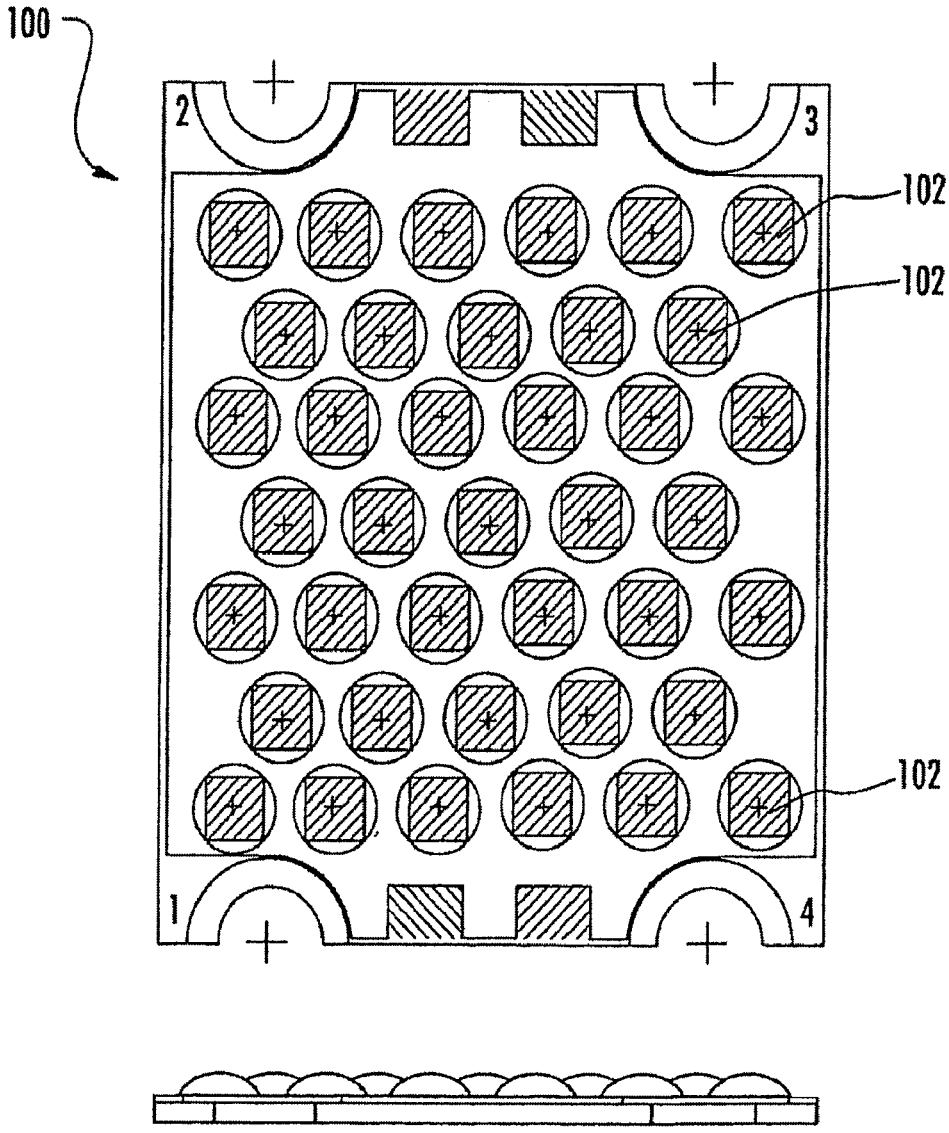
FIG. 6 is a front view showing an LED light engine for use in the submersible light fixture of FIG. 1.
Figure 7:
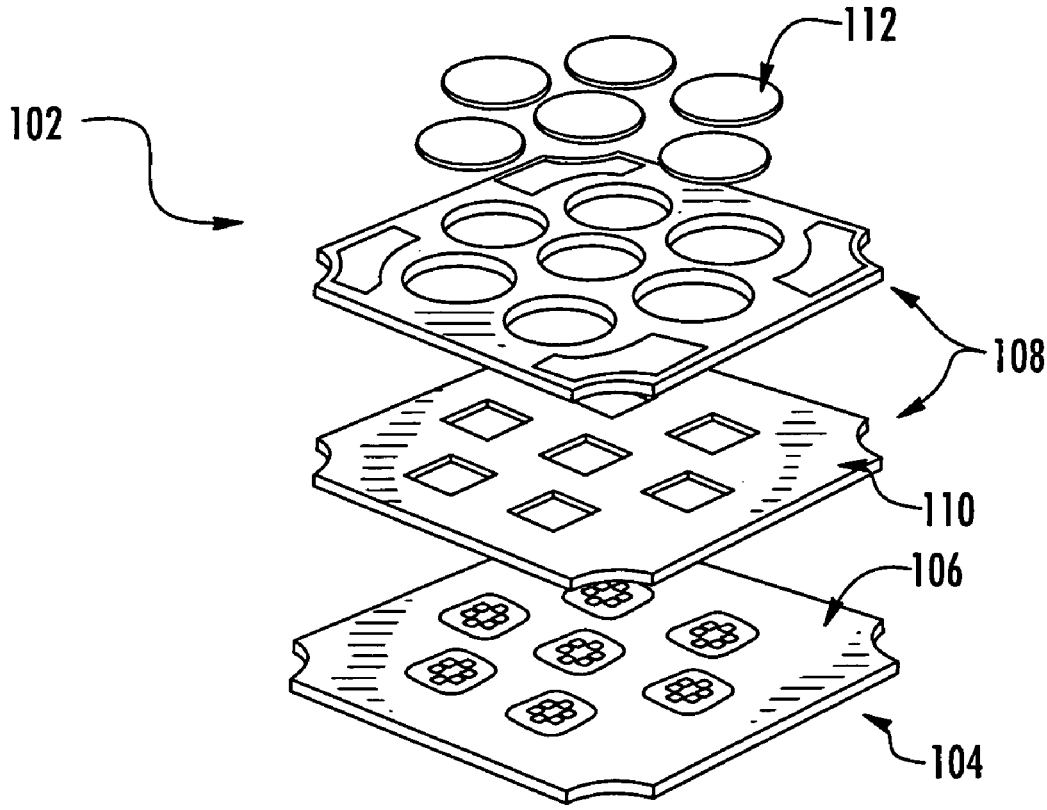
FIG. 7 is an exploded perspective view of an LED array for use in the LED light engine of FIG. 4.

An exemplary LED light engine 100 that may be used as the light engine 24 in the present invention may be manufactured by combining high brightness LEDs with a multilayer low temperature co-fired ceramic on metal (LTCC-M). The LTCC-M allows multiple LEDs to be densely clustered to achieve high luminous intensity in a small array. A suitable LED light engine for use in this invention is the BL-3000 RGB light engine available from Lamina Ceramics of Westhampton, N.J. The BL-3000 LED array is configured with 39 cavities, each populated with multiple LEDs. In the RGB light engine, each cavity contains multiple red, green and blue LED dies for optimal color uniformity. It will of course be appreciated that any number of LEDs can be used, and that any suitable LED array or light engine may be employed in the present invention. An LED light engine 100 is illustrated in FIG. 6, and shows 39 LED arrays 102. An individual LED array 102 is illustrated in FIG. 7, and comprises a metal composite base 104, a plurality of LEDs 106, ceramic layers 108, at least one of which has electrical traces 110 thereon, and lenses 112.

As used herein, a light engine is any optical system that can collect light from a lamp, such as light emitting diode, and deliver the light to a target, which can be used by the target or can be reformatted, such as improving spatial, angular and/or spectral uniformities of the light. Additionally, the light engines can feature one or more LEDs, which can all be a single color or can be various colors.

In the LED light engine 100, the LEDs 114 are mounted directly to the metal composite base 112, which may be a nickel-plated, copper-molybdenum-copper composite, or any suitable metal composite. The base 112 may be formed of a single metal such as copper or aluminum, which are traditionally used for packaging LEDs, but a metal composite, such as the nickel-plated, copper-molybdenum-copper composite used in the example LED light engine has been found to have a thermal coefficient of expansion that is similar to the typical LED chip material. This similarity ensures compatibility of the LED and substrate through a lifetime of heating and cooling as the LEDs are powered on and off, and reduces mechanical stress caused by the expansion and retraction created during heating and cooling cycles.

The LED light engine 24/100 used in the present invention may be in communication with a control console (not shown) operating in compliance with the DMX512, DMX512/1990 or DMX512-A protocols, or any extensions thereof. These protocols can specify the transmission voltages, the data rate, the format of the data content, the type of cable and the type of connector to be used. The DMX protocols additionally can be used to specify the color of the light output by the light engine 24, which may change over time or in a programmed sequence to give a pleasing effect from the light fixture 10. Typically, a plurality of light fixtures 10 will be mounted in the wall of a pool, spa or the like, and varying light colors can be generated in each individual light fixture 10, and also as a sequence or pattern across the plurality of fixtures. The submersible light fixture 10 can thus generate lighting effects that are not possible to achieve with current submersible lights.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A submersible light fixture, comprising:

a housing for a watertight container containing a control module; and an LED light engine abutting a heat conducting plate, the heat conducting plate being supported by the housing, wherein the housing defines an opening substantially adjacent to the heat-conducting plate, wherein the opening is designed to be in fluid communication with a body of water when the light fixture is submerged such that the water acts as a heat sink to the LED light engine, and wherein the opening comprises a gap between the heat conducting plate and the watertight container containing the control module for the LED light engine.

2. The light fixture according to claim 1, wherein the LED light engine is mounted to the heat conducting plate.

3. The light fixture according to claim 1, wherein the gap is a single continuous gap.

4. The light fixture according to claim 1, wherein at least a portion of the watertight container located adjacent to the gap is formed of a non-electrically conducting material.

5. The light fixture according to claim 1, wherein the control module and the LED light engine are electrically connected through a watertight sleeve extending across the gap.

6. The light fixture according to claim 5, wherein the sleeve is positioned off-center to the center of the LED light engine.

7. The light fixture according to claim 5, wherein the sleeve is formed of a non-electrically conducting material.

8. The light fixture according to claim 1, wherein the opening is additionally in fluid communication with a watertight container containing a control module for the LED light engine.

9. The light fixture according to claim 8, wherein the watertight container for the control module comprises a heat conducting base plate that acts to dissipate heat from the control module to the water.

10. The light fixture according to claim 8, wherein a wall of the watertight container for the control module is ribbed to allow water to flow along the sides of the container.

11. The light fixture according to claim 1, wherein the LED light engine comprises a plurality of LEDs which produce red, green and blue light.

12. The light fixture according to claim 1, wherein the LED light engine is protected from contact with water by the heat conducting plate, and by at least one lens positioned over the LED light engine.

13. The light fixture according to claim 1, wherein the heat conducting plate is formed of a metallic material.

14. The submersible light fixture of claim 1, wherein the housing is configured to have several protrusions extending therefrom which form sleeves to receive screws for securing the watertight container and the LED light engine to create the gap there between.

15. A light fixture submersible in water, the light fixture comprising:

a sleeve;

a cap connected to the sleeve to define a watertight housing for a control module positioned therein;

a heat conducting plate connected to the cap and separated therefrom by a plurality of hollow extensions to define a gap between the heat conducting plate and the cap, the gap being defined between a first surface of the heat conducting plate and an opposing surface of the cap; and an LED light engine supported by a second surface of the heat conducting plate and in thermal communication with the heat conducting plate, the first and second surfaces being on opposing sides of the heat conducting plate, wherein the gap is in fluid communication with water when the light fixture is submerged thereby allowing the water to flow through the gap.

16. The light fixture of claim 15, wherein an electrical connection passes through at least one of the plurality of hollow extensions.

17. The light fixture of claim 16, wherein the at least one of the plurality of hollow extensions is off center from the watertight housing.

18. The light fixture of claim 15, wherein one or more fastening devices passes through one or more of the plurality of hollow extensions.

19. The light fixture of claim 15, wherein the plurality of hollow extensions are integrally formed with the cap.

20. The light fixture of claim 15, wherein the gap is a single continuous opening between the heat conducting plate and the cap.

* * * * *